US008069952B2

(12) United States Patent
Schlicker et al.

(10) Patent No.: US 8,069,952 B2
(45) Date of Patent: Dec. 6, 2011

(54) FLUID RESERVOIR ASSEMBLY

(75) Inventors: Scott C. Schlicker, Ferndale, MI (US); Raymond J. Ballou, Milford, MI (US); Chul S. Lee, Northville, MI (US)

(73) Assignee: BASF Aktiengesellschaft, Ludwigshafen (DE)

( * ) Notice: Subject to any disclaimer, the term of this patent is extended or adjusted under 35 U.S.C. 154(b) by 157 days.

(21) Appl. No.: 11/867,888

(22) Filed: Oct. 5, 2007

(65) Prior Publication Data

US 2008/0135340 A1 Jun. 12, 2008

Related U.S. Application Data

(60) Provisional application No. 60/868,804, filed on Dec. 6, 2006.

(51) Int. Cl.
*F16N 31/00* (2006.01)
*F01M 11/04* (2006.01)

(52) U.S. Cl. ..... 184/106; 184/1.5; 184/105.3; 184/109; 220/293; 220/300; 220/304; 251/144; 251/252

(58) Field of Classification Search ..... 184/106, 184/1.5; 137/315.01; 222/548, 549, 551, 222/552, 559; 251/144, 216, 217, 252, 351, 251/352, 904, 353, 297
See application file for complete search history.

(56) References Cited

U.S. PATENT DOCUMENTS

| | | | | |
|---|---|---|---|---|
| 2,241,793 | A * | 5/1941 | Steven | 220/293 |
| 3,869,391 | A | 3/1975 | Kramer | |
| 3,910,550 | A * | 10/1975 | Nelson | 251/144 |
| RE28,844 | E * | 6/1976 | Dehar | 251/144 |
| 4,025,048 | A | 5/1977 | Tibbitts | |
| 4,449,692 | A * | 5/1984 | Rhodes | 251/144 |
| 4,503,934 | A | 3/1985 | Stephanus et al. | |
| 4,717,119 | A * | 1/1988 | Trin | 251/144 |
| 4,938,314 | A | 7/1990 | Sitzler et al. | |
| 4,951,783 | A | 8/1990 | Kamprath et al. | |
| 4,960,153 | A * | 10/1990 | Bergsma | 137/587 |
| 5,086,522 | A | 2/1992 | Stofko, Sr. | |
| 5,107,808 | A | 4/1992 | Mahn et al. | |
| 5,176,215 | A | 1/1993 | Ackerman | |
| 5,184,698 | A | 2/1993 | Coffenberry | |
| 5,197,567 | A | 3/1993 | Rabalais | |
| 5,246,202 | A * | 9/1993 | Beamer | 251/252 |
| 5,299,777 | A | 4/1994 | Milstead | |
| 5,411,115 | A | 5/1995 | Shropshire | |

(Continued)

FOREIGN PATENT DOCUMENTS

JP 2005188675 A * 7/2005

*Primary Examiner* — Robert Siconolfi
*Assistant Examiner* — San Aung
(74) *Attorney, Agent, or Firm* — Howard & Howard Attorneys PLLC

(57) ABSTRACT

A fluid reservoir assembly having a pan defining a drain opening and a plug disposed therein is disclosed. The pan includes a pair of ramps disposed on an inner surface thereof adjacent the drain opening. The plug includes a pair of wings in engagement with the ramps. The ramps increase in height relative to the inner surface of the pan along a first direction of rotation about the central axis. The plug is drawn into sealing engagement with an outer surface of the pan by rotating the plug in the first direction of rotation about the central axis thereby moving the wings up the ramps. The pan includes at least one stop to prevent over-rotation of the plug. The ramps define a recess to secure the wings in a closed position.

27 Claims, 6 Drawing Sheets

U.S. PATENT DOCUMENTS

| | | | | |
|---|---|---|---|---|
| 5,547,042 | A | 8/1996 | Platt | |
| 6,237,639 | B1 * | 5/2001 | Jougla et al. | 137/899.2 |
| 6,655,499 | B2 | 12/2003 | Metheney, Jr. | |
| 6,942,255 | B2 * | 9/2005 | Pickering | 285/136.1 |
| 2003/0094588 | A1 | 5/2003 | Chen | |
| 2004/0112855 | A1 * | 6/2004 | Becker | 215/247 |
| 2005/0236229 | A1 | 10/2005 | Olivas | |
| 2006/0037427 | A1 * | 2/2006 | Holub | 74/606 R |
| 2006/0054401 | A1 | 3/2006 | Wilkins | |
| 2006/0054402 | A1 | 3/2006 | Dorian | |

* cited by examiner

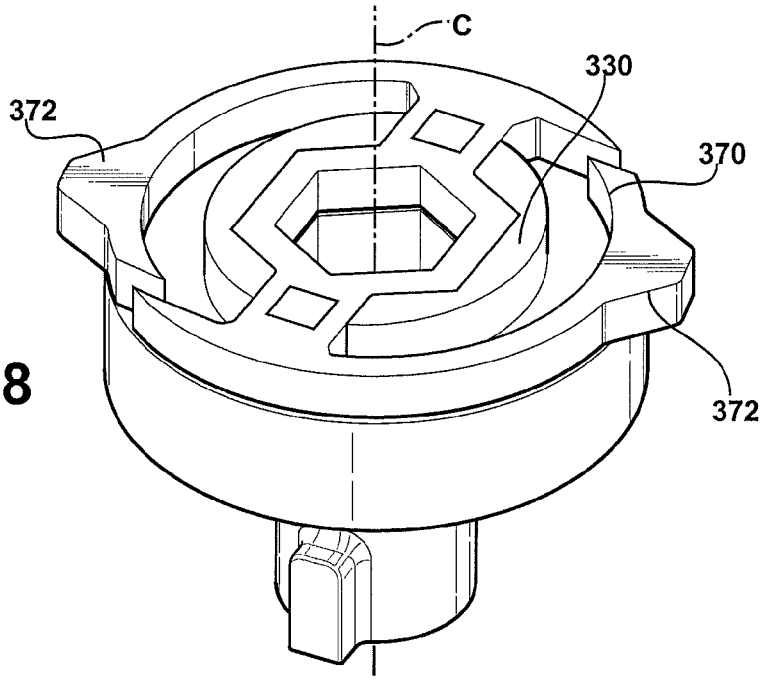
FIG - 8
FIG - 9
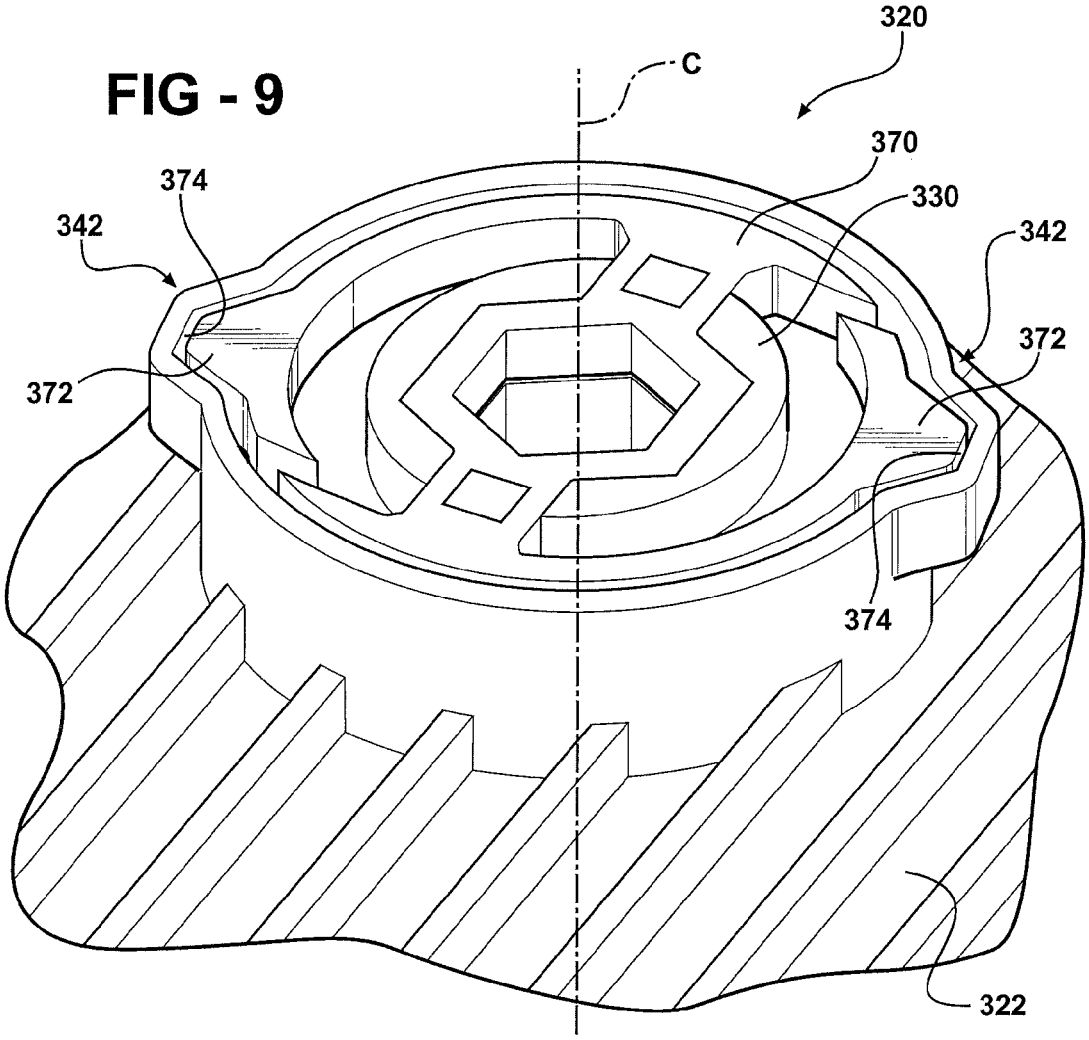

FLUID RESERVOIR ASSEMBLY

CROSS REFERENCE TO RELATED APPLICATION

This application claims the benefit of U.S. provisional patent application Ser. No. 60/868,804, filed on Dec. 6, 2006, the advantages and disclosure of which are hereby incorporated by reference.

BACKGROUND OF THE INVENTION

1. Field of the Invention

The subject invention generally relates to a fluid reservoir assembly for storing a fluid therein.

2. Description of the Related Art

Fluid reservoir assemblies, typified by an oil pan for an engine, include a pan for storing a fluid therein. The pan includes an inner surface and an outer surface and defines a drain opening. To prevent fluid leakage, a plug is in sealing engagement with the outer surface of the pan. The plug includes a base and a shaft extending from the base through the drain opening along a central axis. Typically, the shaft of the plug is in threaded engagement with the pan, thereby attaching the plug to the pan. In such configurations, both the pan and the plug are manufactured from a metal.

Many alternative plugs also exist. One such alternative plug is disclosed in U.S. Pat. No. 5,197,567 to Rabalais (the '567 patent). The '567 patent discloses a plug that includes a base and a shaft extending from the base to a distal end. A clamping member is couple to the distal end of the shaft via a threaded pivot member in threaded engagement with the shaft. The clamping member includes a pair of wings extending radially outward from the shaft. The pair of wings engages the inner surface of the pan. A tool is utilized to rotate the shaft relative to the base and the clamping member, thereby moving the clamping member up or down the shaft, without rotating relative to the pan, through the threaded engagement between the pivot member and the shaft, to draw the base into sealing engagement with the outer surface of the pan. However, drawing the base of the plug tight against the outer surface is difficult as the clamping member tends to unintentionally rotate with the shaft, thereby not advancing nor retreating along the central axis of the shaft relative to the base.

Another alternative plug for sealing a fluid reservoir is disclosed in U.S. Patent Application No. 2006/0054401, Ser. No. 10/897,865 to Wilkins (the '401 publication). The '401 publication discloses a polymer plug for sealing an oil gallery of an internal combustion engine. The oil gallery includes an annular groove, and the polymer plug includes a detent clip having a flange in interlocking engagement with the annular groove to retain the plug within the oil gallery. A boot is disposed at an end of the plug within the oil gallery in sealing engagement with the oil gallery to prevent fluid leakage. The detent device is manually depressed by a user to disengage the flange from the annular groove. However, the polymer detent device is sometimes difficult to grasp and is weakened by repetitive flexing while being removed.

SUMMARY OF THE INVENTION AND ADVANTAGES

The subject invention provides a fluid reservoir assembly for storing a fluid. The fluid reservoir assembly comprises a pan having an inner surface and an outer surface. The pan defines a drain opening extending through the pan. A plug is disposed within the drain opening and is rotatably moveable between a closed position prohibiting fluid flow through the drain opening and an open position permitting fluid flow through the drain opening. The plug includes a base disposed adjacent the outer surface. A shaft extends from the base along a central axis through the drain opening to a distal end. The plug further includes at least one wing extending radially outward transverse to the central axis. A ramp is disposed on the inner surface of the pan adjacent the drain opening. The at least one wing is in engagement with the ramp to move the base into sealing engagement against the outer surface when in the closed position. The at least one wing also engages the ramp to move the base out of sealing engagement with the outer surface when in the open position.

Accordingly, the subject invention provides a fluid reservoir assembly that is easily moved between the open position and the closed position by hand, without the use of a tool, due to the simple mechanical interaction between the ramps and the wings. Hand operation of the plug increases the ease and efficiency of fluid maintenance. The fluid reservoir assembly is also especially well suited for manufacture from a polymer material because of the simple geometric design configuration of the ramps and wings. A polymer fluid reservoir assembly reduces production costs and the weight of the fluid reservoir assembly.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 8 is an exploded perspective view of a plug of a third embodiment of the fluid reservoir assembly;

FIG. 9 is a fragmentary plan view of the third embodiment of the fluid reservoir assembly.

DETAILED DESCRIPTION OF THE INVENTION

Figure 1:
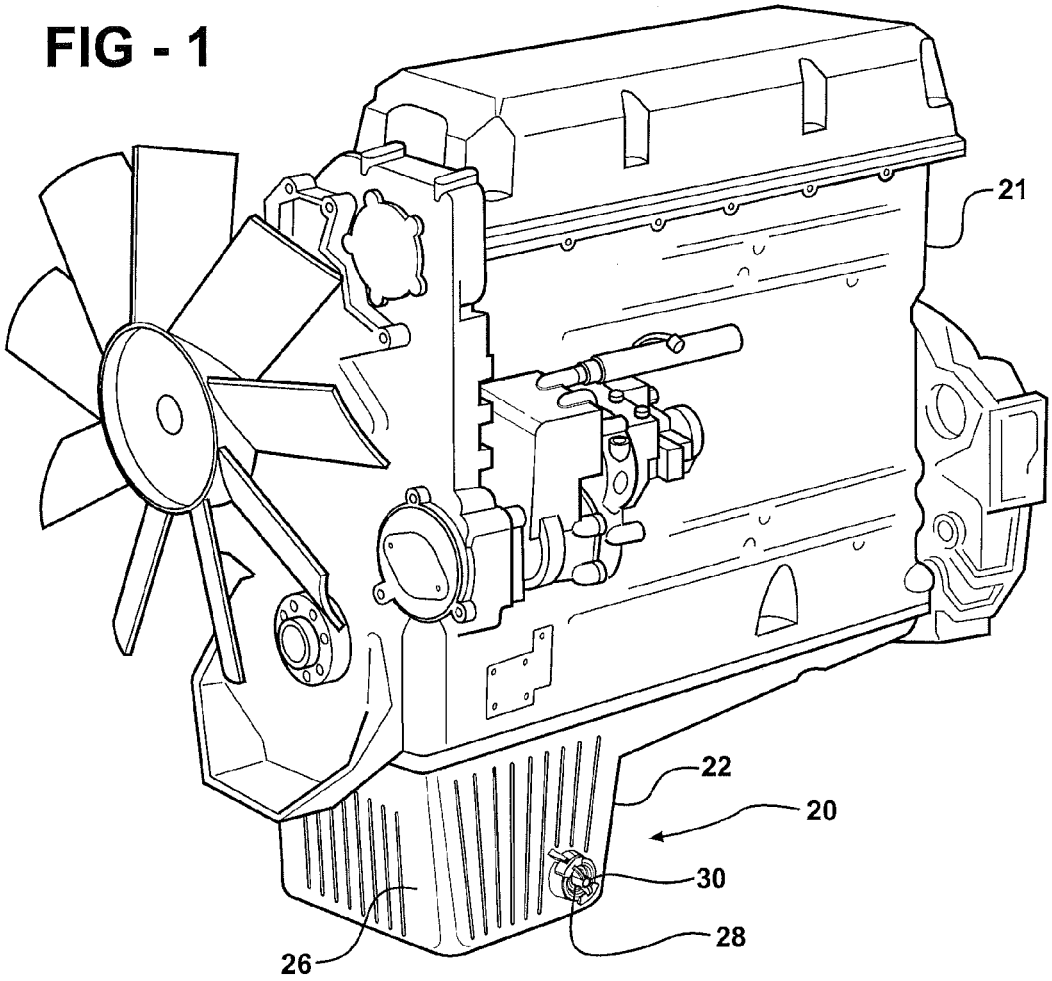
FIG. 1 is a perspective view of an engine including a first embodiment of a fluid reservoir assembly.

Referring to the Figures, wherein like numerals indicate corresponding parts throughout the several views, a first embodiment of a fluid reservoir assembly is shown generally at 20 in FIG. 1. The reservoir assembly 20 may be incorporated into several different devices. One contemplated embodiment of the first embodiment of the fluid reservoir assembly 20 is that of an oil pan for an engine 21. While the first embodiment of the fluid reservoir assembly 20 of this disclosure is hereinafter referred to and shown as embodied by an oil pan, it should be understood that the subject invention may be incorporated into other devices, such as a bucket, a pitcher, a power steering fluid pump reservoir, a brake fluid reservoir, etc., and should not be limited to the specific embodiment of an oil pan described herein.

Figure 2:
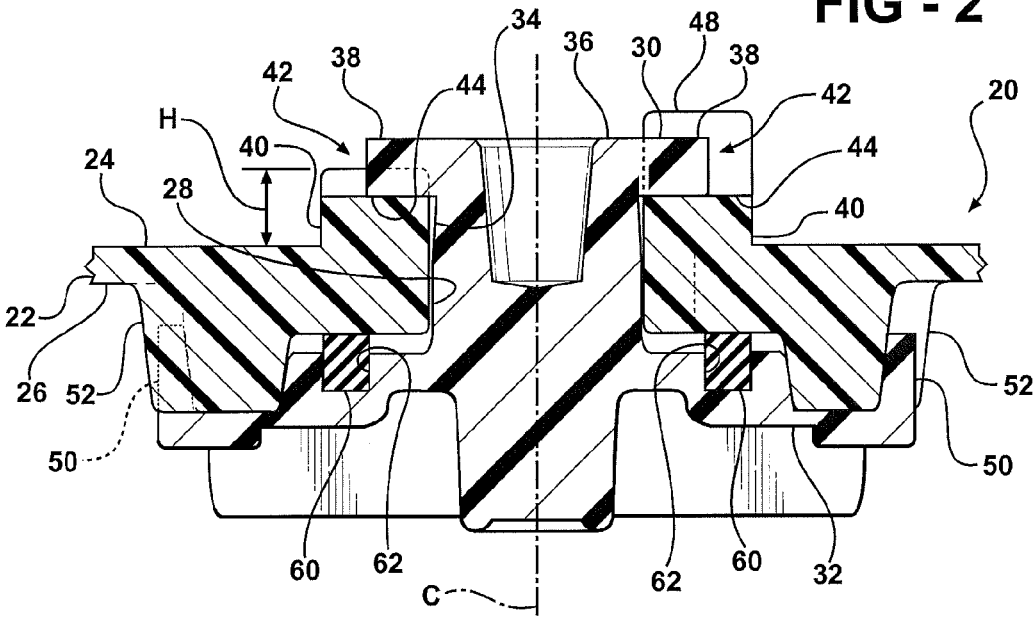
FIG. 2 is a fragmentary cross sectional view of the first embodiment of the fluid reservoir assembly.

The first embodiment of the fluid reservoir assembly 20 comprises a pan 22. Referring also to FIG. 2, the pan 22 includes an inner surface 24 and an outer surface 26. The pan 22 defines a cavity for storing a fluid therein, and also defines a drain opening 28 extending through the pan 22. The drain opening 28 allows for removal of the fluid from the cavity as required. As the embodiment described herein is an oil pan 22 for an engine, the fluid includes a motor oil. However, it should be appreciated that the type of fluid will vary with the different embodiments of the subject invention.

Figure 4:
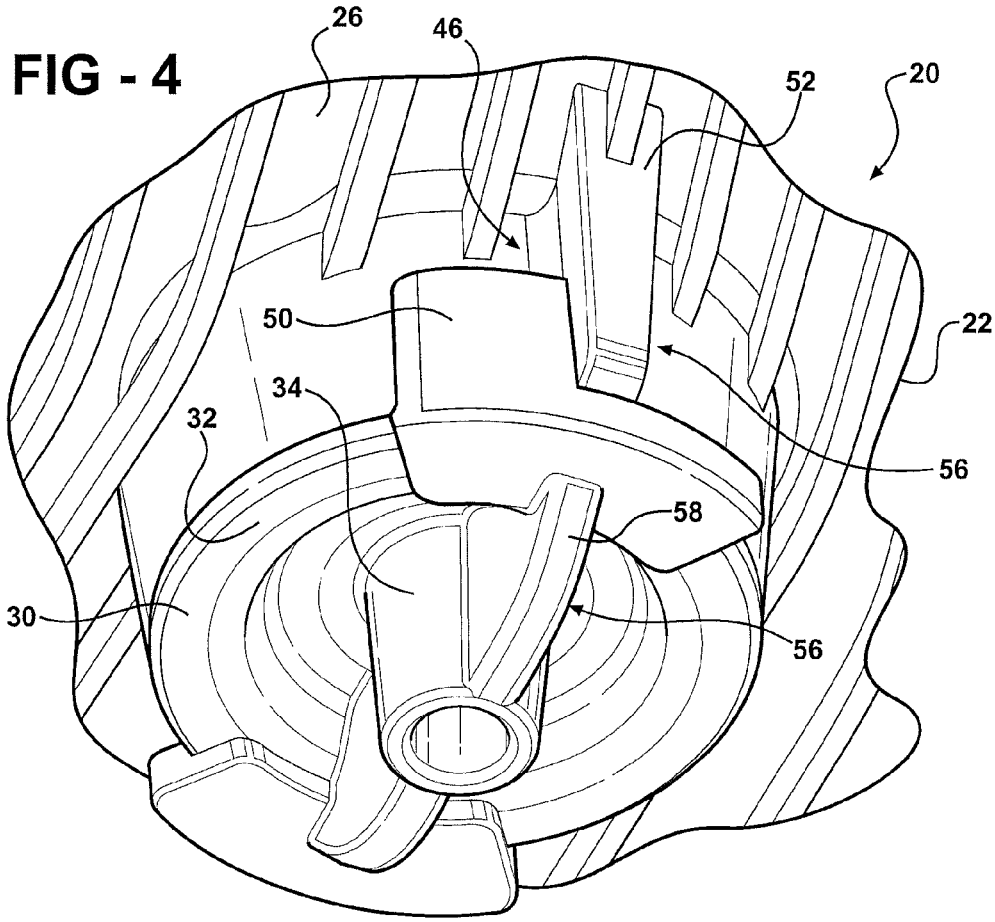
FIG. 4 is a fragmentary perspective view of an outer surface of the first embodiment of the fluid reservoir assembly.

A plug 30 is disposed within the drain opening 28. The plug 30 is rotatably moveable between a closed position prohibiting fluid flow through the drain opening 28, and an open position permitting fluid flow through the drain opening 28. As best shown in FIG. 4, the plug 30 includes an aesthetic design to impart the impression of "finger-tight" operation, i.e., the plug 30 is to be manually rotated by hand without the use of a tool, such as a wrench. This may be accomplished be designing the plug 30 to resemble a knob, such as is used for an air conditioning knob within an automobile.

Figure 3:
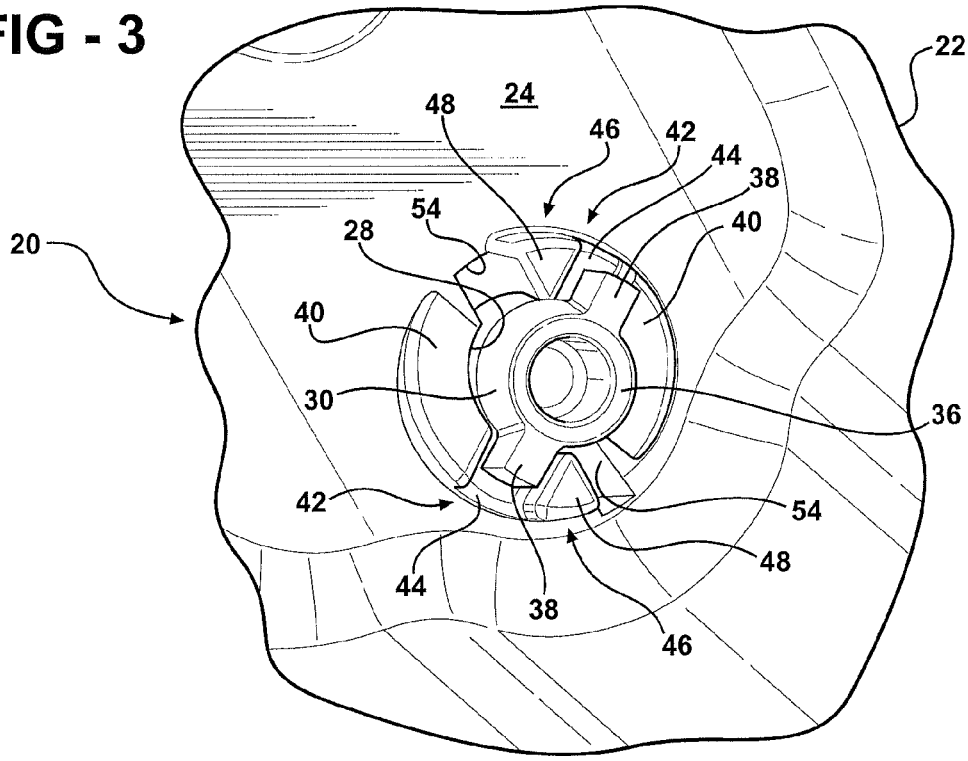
FIG. 3 is a fragmentary perspective view of an inner surface of the first embodiment of the fluid reservoir assembly.
Figure 6:
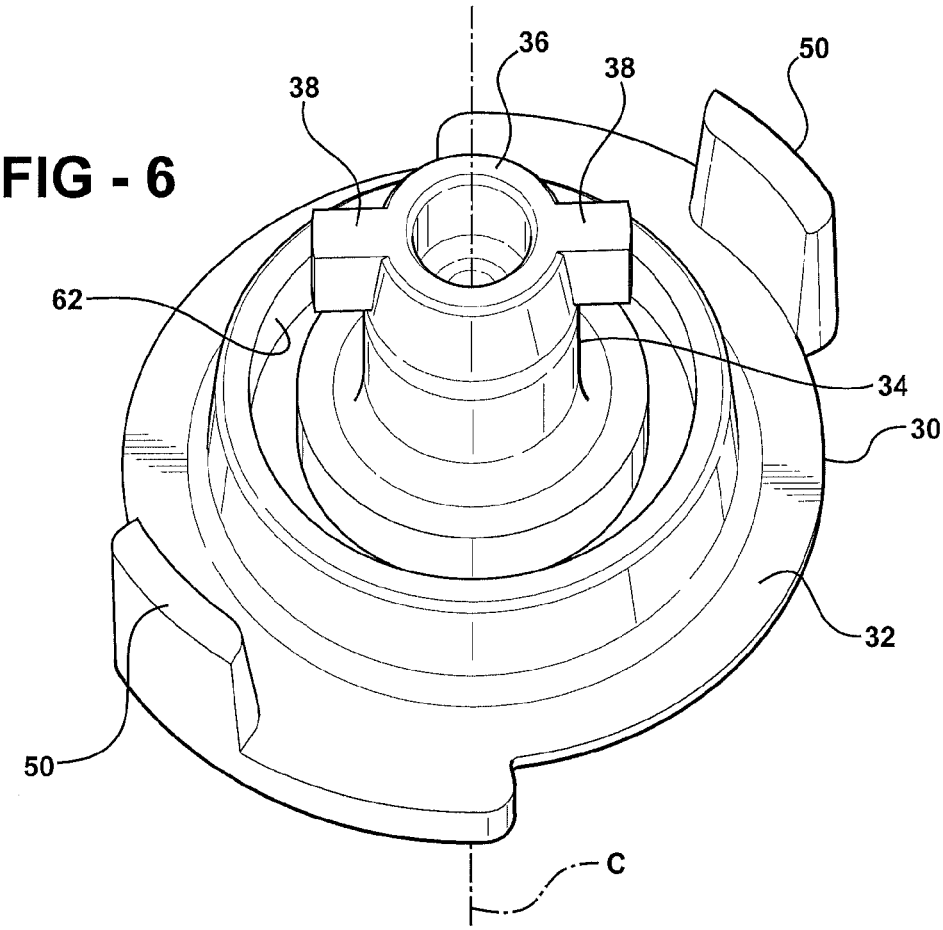
FIG. 6 is a perspective view of the plug of the first embodiment of the fluid reservoir assembly.

Referring back to FIG. 2, with reference to FIGS. 3, 4, and 6, the plug 30 includes a base 32 disposed adjacent the outer surface 26 of the pan 22. A shaft 34 extends from the base 32 along a central axis C through the drain opening 28 to a distal end 36. The distal end 36 is disposed adjacent the inner surface 24, within the cavity of the pan 22. The plug 30 further includes at least one wing 38 extending radially outward from the distal end 36 of the shaft 34, transverse to the central axis C. Preferably, the plug 30 includes a pair of wings 38 as is shown, spaced opposite each other across the shaft 34, i.e., the wings 38 are spaced 180° apart relative to each other about the shaft 34.

At least one ramp 40 is disposed on the inner surface 24 of the pan 22, within the cavity. Preferably, the reservoir assembly 20 includes a pair of ramps 40 as is shown, spaced opposite each other across the drain opening 28, i.e., the ramps 40 are spaced apart relative to each other about the drain opening 28. Although not required, the ramps 40 include a semicircular shape and are disposed about the outer periphery of the drain opening 28 on the inner surface 24 of the pan 22 adjacent the drain opening 28. It should be appreciated that the ramps could include some other shape. The ramps 40 define a height H which increases in value relative to the inner surface 24 of the pan 22. The height H of the ramps 40 increases along a first direction of rotation, i.e. the ramps 40 define a slope increasing in value along the first direction of rotation. The slope may be either constant or variable.

Preferably, the height H of the ramps 40 rises from a point on the inner surface 24 measuring 0.0 mm above the inner surface 24 of the pan 22 to a point measuring 3.5 mm above the inner surface 24 of the pan 22, over a 120° angle of rotation about the drain opening 28. However, it should be appreciated that the ramps 40 may be configured to include a different height H and a different angle of rotation about the drain opening 28. Preferably, the ramps 40 are integrally formed with the pan 22. However, it should be appreciated that the ramps 40 may be separate members attached to the pan 22 by suitable methods determined by the type of fluid and conditions of use.

As shown in FIGS. 2 and 3, the wings 38 are in engagement with the ramps 40. The wings 38 are moveable up the ramps 40, away from the inner surface 24, in response to rotation of the plug 30 in the first direction of rotation. Movement of the wings 38 up the ramps 40 moves the base 32 into sealing engagement against the outer surface 26 and into the closed position. The wings 38 are also moveable down the ramps 40 toward the inner surface 24 of the pan 22 in response to rotation of the plug 30 opposite the first direction of rotation. Movement of the wings 38 down the ramps 40 moves the base 32 out of sealing engagement with the outer surface 26 and into the open position.

As shown in FIGS. 2, 3, and 6, the pan 22 includes a pair of ramps 40 and the plug 30 includes a pair of wings 38. Therefore, it should be understood that the at least one ramp 40 includes a plurality of ramps 40 and the at least one wing 38 includes a plurality of wings 38 corresponding in number to the plurality of ramps 40. Accordingly, the reservoir assembly 20 could include three, four, five, or some other number of corresponding ramps 40 and wings 38, preferably equally spaced about the drain opening 28 and the shaft 34 respectively. As such, it should be understood that the number of ramps 40 and the number of wings 38 may vary, and that the corresponding geometric arrangement of the ramps 40 and wings 38 may also vary accordingly.

The reservoir assembly 20 further comprises a lock mechanism 42 to secure the plug 30 in the closed position. As shown in FIGS. 2 and 3, the lock mechanism 42 includes a recess 44 defined by the ramp 40. The recess 44 is spaced from the inner surface 24 for receiving the wings 38 therein, i.e., the recess 44 is at the top of the ramps 40.

The wings 38 engage the recess 44 in interlocking engagement to restrain rotation of the plug 30. Preferably, the recess 44 is disposed 1 mm below the highest elevation of the ramp 40 as measured relative to the inner surface 24 of the pan 22. Accordingly, when rotating the plug 30 into the closed position, the plug 30 is rotated in the first direction such that the wings 38 travel up the ramps 40. As the wings 38 travel up the ramps 40, the base 32 of the plug 30 is drawn closer to the outer surface 26 of the pan 22. The plug 30 is rotated past the highest portion of the ramp 40 into the recess 44, where the wings 38 "snap" down into the recess 44. The sensation of the wings 38 snapping into the recess 44 indicates to the user that the plug 30 is in the closed position. Additionally, the wings 38 are prevented from rotating down the ramps 40, opposite the first direction, thereby loosening the plug 30, i.e., the wings 38 are locked within the recess 44 to retain the plug 30 within the drain 28. It should be understood that the lock mechanism 42 may be configured other than as shown and described herein to secure the plug 30 within the drain opening 28. The second and third embodiments of the fluid reservoir assembly 220, 320 each disclose alternative embodiments for the lock mechanism 242, 342.

The reservoir assembly 20 further comprises a stop 46. The stop 46 prevents rotation of the plug 30 in the first direction past the closed position. Preferably, and as shown in FIG. 3, the stop 46 includes a block 48 disposed on the inner surface 24 of the pan 22 adjacent each of the recesses 44 in each of the ramps 40. The blocks 48 abut the wings 38 when the plug 30 is in the closed position to prevent rotation of the wings 38 past the recess 44. However, it should be appreciated that the stop 46 need not include the blocks 48, and that the stop 46 may include another embodiment as described below or be incorporated into the lock mechanism such as shown in the second embodiment of the fluid reservoir assembly 220 described below. Referring back to FIG. 4, the stop 46 may include, independently of or in combination with the blocks 48, a tab 50 attached to the plug 30 and a wall 52 disposed on the outer surface 26 of the pan 22 to abut the tab 50 when the plug 30 is in the closed position. The tab 50 extends radially from the base 32 of the plug 30 transversely to the central axis C. The wall 52 is disposed on the outer surface 26 adjacent the drain opening 28 and abuts the tab 50 in the closed position to prevent rotation of the tab 50 past the wall 52. Preferably, there is a pair of walls 52 disposed opposite each other around the drain 28. i.e., the walls 52 are disposed about the outer periphery of the drain 28 and are spaced 180° apart from each other. The tabs 50 extend from the plug 30 and are also disposed opposite each other, i.e., 180° apart from each other in corresponding relation relative to the walls 52. It should be appreciated that the reservoir assembly 20 may include any number of corresponding walls 52 and tabs 50 to prevent over-rotation of the plug 30. It should also be appreciated that the stop 46 may include other devices or configurations suitable to stop over-rotation of the plug 30 other than specifically described herein, or any combination of devices or configurations either disclosed herein or not.

Figure 5:
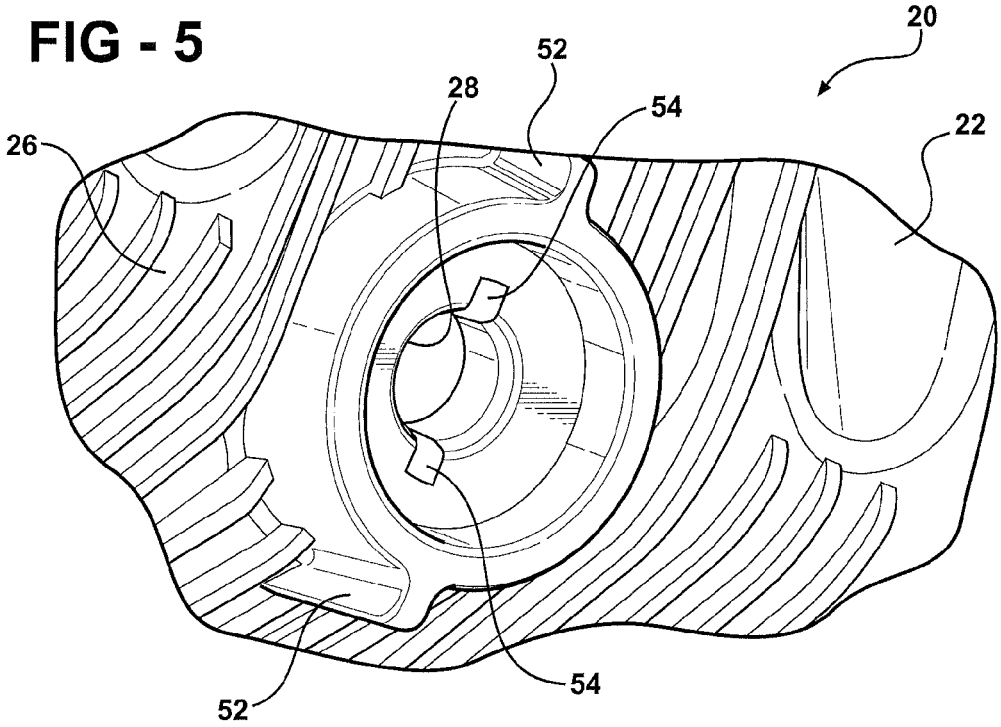
FIG. 5 is a fragmentary perspective view of the outer surface of the first embodiment of the fluid reservoir assembly without a plug.

As best shown in FIG. 5, the pan 22 defines at least one notch 54 adjacent the drain opening 28 to permit the at least one wing 38 to pass therethrough to allow removal and insertion of the plug 30 from and into the drain opening 28 respectively. It should be understood that there will be a corresponding number of notches 54 and wings 38, with the notches 54 oriented in the same fashion as the wings 38 relative to the shaft 34. Accordingly, the shaft 34 of the plug 30 may be completely removed from the drain 28. It should also be appreciated that the notches 54 are shaped similarly to, yet slightly larger than the wings 38 to permit the wings 38 to pass therethrough unobstructed.

Referring to FIG. 4, the plug 30 may include an indicator 56 for visually indicating that the plug 30 is in the closed position. The visual indication of the plug 30 being in the closed position signals the user not to rotate the plug 30 further, thereby damaging the plug 30 or the pan 22. The indicator 56 may include a ridge 58 on the plug 30 that aligns with a marking disposed on the pan 22 when the plug 30 is rotated into the closed position. The marking may include one of the walls 52, as shown, or may include some other indicia on the pan 22. It should be understood that the indicator 56 may be configured other than shown and described herein to indicate the plug 30 is in the closed position.

Referring back to FIG. 2, the plug 30 includes a gasket 60 is disposed between the base 32 of the plug 30 and the outer surface 26 of the pan 22. Preferably, the base 32 defines an annular groove 62 opposing the outer surface 26 with the gasket 60, comprising a rubber o-ring gasket 60 or the like, disposed within the annular groove 62. However, it should be understood that other types of gaskets 60 and gasket 60 materials may be utilized which require a different configuration of the plug 30. The type and material of gasket 60 is chosen to accommodate the fluid contained within the cavity of the pan 22 and the operating condition of the fluid and the reservoir assembly 20.

Preferably, the plug 30 and the pan 22 comprise a polymer. However, it should be appreciated that the pan 22 and the plug 30 may comprise some other material, such as a metal. Alternatively, the pan 22 and the plug 30 may comprise a combination of materials, such as a metal pan 22 and a polymer plug 30.

The polymer may or may not include glass reinforcement and should be a higher temperature grade of polymer suitable for use in environments reaching up to 150° C. The polymer utilized for the plug 30 and for the pan 22 may include a polyamide (such as Nylon 6 p-grade or Nylon 6/6 p-grade), a polyoxymethylene (such as acetal), or any other polymer suitable for the desired use. The polymer material utilized for the plug 30 should be physically compatible with the polymer material utilized for the pan 22, i.e., the polymer materials for the plug 30 and the pan 22 should have matching thermal expansion characteristics and moisture related dimensional growth characteristics. Additionally, when the subject invention is embodied as an oil pan for storing motor oil therein, the polymer utilized for the plug 30 and the pan 22 should include an inherent chemical resistance against long term exposure to motor oil under hot environmental conditions, and also include a high impact resistance. It should be understood that the polymer may require different characteristics if utilized with a fluid other than motor oil. A specific example of a polymer suitable for the plug 30 and the pan 22 is Ultramid® A3WG7, manufactured by BASF Corporation. It should be understood that other specific types of polymer materials may also be utilized with the subject invention.

Since the plug 30 and the pan 22 are manufactured from the polymer material, it is important not to over-rotate or over-tighten the plug 30 to prevent damaging the plug 30 and the pan 22. However, in the event the plug 30 is over-rotated, it is preferable that the plug 30 fails before the pan 22. Therefore, the plug 30 includes a fracture geometry to ensure the wings 38 fracture before the stop 46 fractures or the pan 22 fractures in response to over-rotation of the plug 30. Accordingly, in the event of over-rotation of the plug 30, the plug 30 fails before the pan 22 and only the plug 30 need be replaced. The fracture geometry may include a stress line engineered into the plug 30, separating each of the wings 38 from the shaft 34, which is engineered to fail upon application of sufficient force to the plug 30 prior to failure of the stop 46. Similarly, the wings 38 may be engineered to include a shear stress point less than that of the stops 46 by way of having a smaller cross-sectional area or by way of being manufactured from a weaker material than that used to manufacture the stop 46 and the pan 22. It should be appreciated that the fracture geometry may be accomplished in other manners than specifically described herein so long as the wings 38 fail before the stop 46 or the pan 22.

Figure 7:
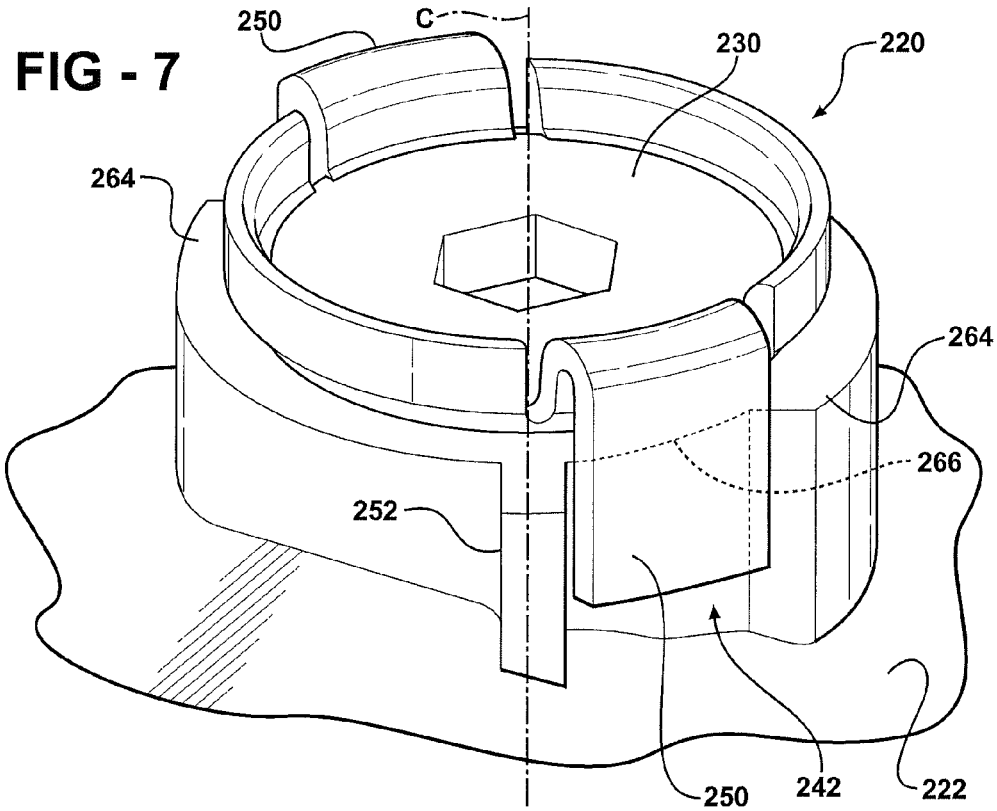
FIG. 7 is a fragmentary perspective view of a second embodiment of the fluid reservoir assembly.
Figure 7A:
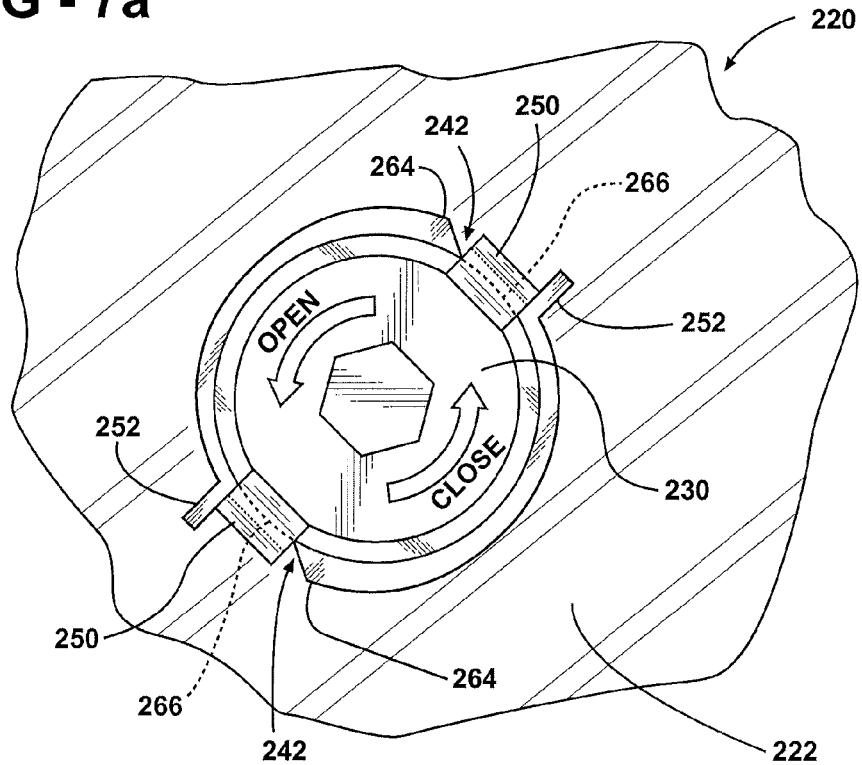
FIG. 7*a* is a fragmentary plan view of the second embodiment of the fluid reservoir assembly.

Referring to FIGS. 7 and 7*a*, a second embodiment of the fluid reservoir assembly is shown generally at 220. Features of the second embodiment of the fluid reservoir assembly that are also common to the first embodiment of the fluid reservoir assembly are identified with the same reference numeral used for the first embodiment of the fluid reservoir assembly preceded by the integer 2, representing the second embodiment. For example, the pan, which is common to both the first embodiment of the fluid reservoir assembly 20 and the second embodiment of the fluid reservoir 220, utilizes the reference numeral 22 in the first embodiment of the fluid reservoir assembly 20 and utilizes the reference numeral 222 in the second embodiment of the fluid reservoir assembly 220.

The second embodiment of the fluid reservoir assembly 220 includes an alternative lock mechanism 242. In the second embodiment of the fluid reservoir assembly 220, the lock mechanism 242 includes the tabs 250 disposed on the plug 230 engaging at least one seat 266 defined by the pan 222. The tabs 250 are in interlocking engagement when the plug 230 is in the closed position. The pan 222 further includes at least one wedge 264, preferably with a pair of wedges 264 abutting the seats 266. Accordingly, when rotating the plug 230 from the open position into the closed position, the tabs 250 move along the wedges 264, and are thereby urged away from each other, with the wedges 264 spreading the tabs 250 slightly until the tabs 250 snap into the seats 266. As the tabs 250 snap into the seats 266, the tabs 250 are allowed to return to their normal resting position. As such, the tabs 250 must be spread away from each other in order to re-engage the wedges 264 and release the plug 230 from the closed position. The second embodiment of the fluid reservoir assembly 220 further includes the walls 252 abutting the tabs 250 and cooperating together to define the stop 246. As such, the block 248 (not shown in FIGS. 7 and 7*a*) may be incorporated into the plug 230 is so desired, or may alternatively be omitted as shown.

Referring to FIGS. 8 and 9, a third embodiment of the fluid reservoir assembly is shown generally at 320. Features of the third embodiment of the fluid reservoir assembly that are also common to the first embodiment of the fluid reservoir assembly are identified with the same reference numeral used for the first embodiment of the fluid reservoir assembly preceded by the integer 3, representing the third embodiment. For example, the pan, which is common to both the first embodiment of the fluid reservoir assembly 20 and the third embodiment of the fluid reservoir 320, utilizes the reference numeral 22 in the first embodiment of the fluid reservoir assembly 20 and utilizes the reference numeral 322 in the third embodiment of the fluid reservoir assembly 320.

The third embodiment of the fluid reservoir assembly 320 also includes an alternative lock mechanism 342. In the third embodiment of the fluid reservoir assembly 320, the lock mechanism 342 includes a snap ring 370 coupled to the plug 330 for rotation with the plug 330 between the open position and the close position. The snap ring 370 includes at least one flange 372, but preferably a pair of radially opposed flanges 372. The flanges 372 are compressible toward the central axis C. The lock mechanism 342 further includes at least on depression 374 defined by the pan 322, but preferably a pair of depressions 374. The flanges 372 engage the depressions 374 in interlocking engagement when the plug 330 is in the closed position. To release the plug 330 from the closed position, the flanges 372 are compressed toward the central axis C to a point where the flanges 372 no longer engage the depressions 374, thereby allowing rotation of the plug 330. Preferably, the snap ring 370 is separate from the plug 330; however it should be appreciated that the snap ring 370 and the plug 330 could be integrally formed together.

Figure 10:
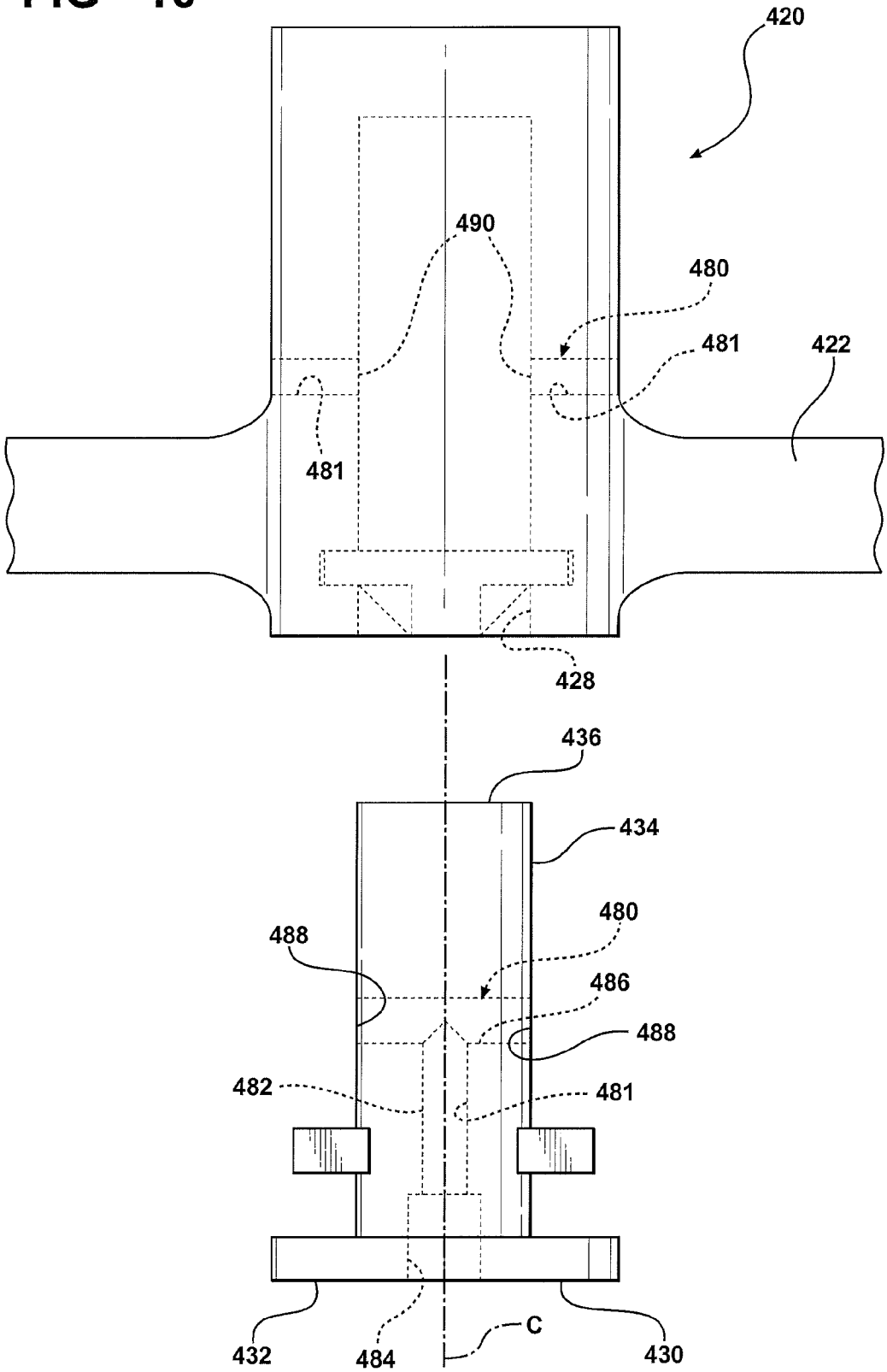
FIG. 10 is an exploded side view of a fourth embodiment of the fluid reservoir assembly.

Referring to FIG. 10, a fourth embodiment of the fluid reservoir assembly is shown generally at 420. Features of the fourth embodiment of the fluid reservoir assembly that are also common to the first embodiment of the fluid reservoir assembly are identified with the same reference numeral used for the first embodiment of the fluid reservoir assembly preceded by the integer 4, representing the fourth embodiment. For example, the pan, which is common to both the first embodiment of the fluid reservoir assembly 20 and the fourth embodiment of the fluid reservoir 420, utilizes the reference numeral 22 in the first embodiment of the fluid reservoir assembly 20 and utilizes the reference numeral 422 in the fourth embodiment of the fluid reservoir assembly 420.

The fourth embodiment of the fluid reservoir assembly 420 incorporates an internal fluid removal mechanism 480 for removing the fluid from with in the pan 422 without fully removing the plug 430 from the drain opening 428. The fluid removal mechanism 480 includes a passageway 481 extending through the shaft 434 of the plug 430. The passageway 481 includes a first portion 482, preferably concentric with the central axis C. The first portion 482 extends partially into the shaft 434 of the plug 430, from the base 432 toward the distal end 436 of the plug 430. The first portion 482 defines a fluid exit 484 at the base 432 of the plug 430. The passageway 481 further includes a second portion 486, which is in fluid communication with the first portion 482 and extends transverse to the central axis C to an outer edge of the shaft 434. The second portion 486 defines a fluid entrance 488, so that the fluid may enter through the fluid entrance 488 and flow through the second portion 486 of the passageway 481 and the first portion 482 of the passageway 481, exiting the fluid reservoir assembly 420 through the fluid exit 484.

The inner surface 424 of the pan 422 defines a fluid port 490 for engaging the fluid entrance 488 in fluid communication when the plug 430 is in a drain position. The drain position is located between the open position and the closed position. The fluid port 490 is disengaged from the fluid entrance 488 when the plug 430 is in the closed position. Accordingly, by rotating the plug 430 from the closed position into the drain position, the fluid entrance 488 becomes aligned with the fluid port 490. The fluid stored within the cavity of the fluid reservoir assembly 420 is then free to flow through the fluid port 490, into the passageway 481 of the plug 430, and exit the fluid reservoir assembly 420 through the fluid exit 484. It should be appreciated that the fluid removal mechanism may be configured other than described or shown herein.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A fluid reservoir assembly for storing a fluid, said assembly comprising:

a pan having an inner surface and an outer surface and defining a drain opening extending through said pan from said inner surface to said outer surface;

a plug disposed within said drain opening and rotatably moveable between a closed position prohibiting fluid flow through said drain opening and an open position permitting fluid flow through said drain opening;

said plug including a base disposed adjacent said outer surface and a shaft extending from said base along a central axis through said drain opening to a distal end and further including at least one wing disposed adjacent said inner surface and extending radially outward from said distal end transverse to said central axis;

at least one ramp disposed on said inner surface of said pan adjacent said drain opening with said at least one wing in engagement with said ramp to move said base into sealing engagement against said outer surface when in said closed position and to move said base out of sealing engagement with said outer surface when in said open position;

a lock mechanism to secure said plug in said closed position; and a stop to prevent rotation of said plug in said first direction past said closed position;

wherein said plug includes a fracture geometry to ensure said at least one wing fractures before said stop fractures in response to over tightening of said plug.

2. An assembly as set forth in claim 1 wherein said at least one ramp includes a plurality of ramps and said at least one wing includes a plurality of wings corresponding in number to said plurality of ramps.

3. An assembly as set forth in claim 1 wherein said at last one ramp includes a height increasing relative to said inner surface along a first direction of rotation to define a slope.

4. An assembly as set forth in claim 1 wherein said lock mechanism includes a recess defined by said at least one ramp and spaced from said inner surface for receiving said at least one wing therein.

5. An assembly as set forth in claim 1 wherein said lock mechanism includes at least one seat defined by said pan and said plug includes at least one tab extending from said base transversely from said central axis for engaging said seat in interlocking engagement when said plug is in said closed position.

6. An assembly as set forth in claim 1 wherein said lock mechanism includes a snap ring coupled to said plug and having at least one flange compressible toward said central axis and wherein said lock mechanism further includes at least one depression defined by said pan for engaging said at least one flange in interlocking engagement when said plug is in said closed position.

7. An assembly as set forth in claim 1 further comprising a fluid removal mechanism for draining the fluid from within said pan without removing said plug from said drain opening.

8. An assembly as set forth in claim 7 wherein said fluid removal mechanism includes a passageway defined by and extending through said shaft of said plug and said fluid removal mechanism further includes a port defined by said pan in fluid communication with said passageway when said plug is disposed in a drain position between said open position and said closed position.

9. An assembly as set forth in claim 5 wherein said lock mechanism includes a recess defined by said at least one ramp and spaced from said inner surface for receiving said at least one wing therein and wherein said stop includes a block disposed on said inner surface of said pan adjacent said recess to abut said at least one wing in said closed position and prevent rotation of said at least one wing past said recess.

10. An assembly as set forth in claim 1 wherein said plug includes a tab extending from said base transversely to said central axis and spaced from said wing along said central axis and wherein said stop includes a wall disposed on said outer surface adjacent said drain opening to abut said tab in said closed position and prevent rotation of said tab past said wall.

11. An assembly as set forth in claim 1 wherein said pan defines at least one notch adjacent said drain opening to permit said at least one wing to pass therethrough to allow removal of said plug from said pan.

12. An assembly as set forth in claim 1 wherein said plug includes an indicator to indicate when said plug is in said closed position.

13. An assembly as set forth in claim 1 wherein said plug includes a gasket disposed between said base and said outer surface.

14. An assembly as set forth in claim 13 wherein said base defines an annular groove opposing said outer surface and said gasket is disposed within said annular groove.

15. An assembly as set forth in claim 1 wherein said pan and said plug comprise a polymer.

16. An assembly as set forth in claim 15 wherein said polymer includes a glass reinforced polymer.

17. An assembly as set forth in claim 15 wherein said polymer includes at least one of a polyamide and a polyoxymethylene.

18. A plug for use with a pan having an inner surface and an outer surface and defining a drain opening extending through the pan with at least one ramp disposed on the inner surface of the pan, said plug comprising:

a base;

a shaft extending from said base along a central axis to a distal end;

at least one wing extending radially outward from said distal end transverse to said central axis for engaging the ramp to move said base into sealing engagement against the outer surface of the pan in response to rotation of said plug in a first direction of rotation and to move said base out of sealing engagement with the outer surface of the pan in response to rotation of said plug opposite the first direction of rotation; and wherein said plug includes a fracture geometry to ensure said at least one wing fractures before the pan fractures in response to over tightening of the plug.

19. A plug as set forth in claim 18 further comprising a polymer.

20. A plug as set forth in claim 19 wherein said polymer includes a glass reinforced polymer.

21. A plug as set forth in claim 20 wherein said polymer includes one of a group comprising a polyamide and a polyoxymethylene.

22. A fluid reservoir assembly for storing a fluid, said assembly comprising:

a pan having an inner surface and an outer surface and defining a drain opening extending through said pan from said inner surface to said outer surface;

a plug disposed within said drain opening and rotatably moveable between a closed position prohibiting fluid flow through said drain opening and an open position permitting fluid flow through said drain opening;

said plug including a base disposed adjacent said outer surface and a shaft extending from said base along a central axis in said drain opening and further including at least one wing extending radially outward transverse to said central axis; and at least one ramp disposed on said pan adjacent said drain opening with said at least one wing in engagement with said ramp to move said base into sealing engagement with said pan when in said closed position and to move said base out of sealing engagement with said pan when in said open position;

wherein said pan and said plug comprise a polymer; and wherein said plug includes a fracture geometry to ensure said at least one wing fractures before said pan fractures in response to over tightening of said plug.

23. An assembly as set forth in claim 22 further comprising a stop that abuts said at least one wing when said plug is in the closed position to prevent rotation of said plug in said first direction past said closed position.

24. An assembly as set forth in claim 23 wherein said stop is defined on said pan and wherein said fracture geometry of said plug ensures that said at least one wing fractures before said stop fractures in response to over tightening of said plug.

25. An assembly as set forth in claim 22 wherein said plug includes a tab disposed adjacent said base and spaced from said wing along said central axis and wherein said stop includes a wall disposed on said outer surface adjacent said drain opening to abut said tab in said closed position and prevent rotation of said tab past said wall.

26. An assembly as set forth in claim 22 wherein said polymer includes a glass reinforced polymer.

27. An assembly as set forth in claim 22 wherein said polymer includes at least one of a polyamide and a polyoxymethylene.

* * * * *